US005669701A

United States Patent [19]

Lin

[11] Patent Number: 5,669,701

[45] Date of Patent: Sep. 23, 1997

[54] LAMP HOLDER STRUCTURE

[76] Inventor: Fong-Shi Lin, 2F, No. 7, Alley 5, Lane 212, Chung-Cheng Road, Shih-Lin, Taipei City, Taiwan

[21] Appl. No.: 685,679

[22] Filed: Jul. 24, 1996

[51] Int. Cl.[6] ..... H01R 33/00

[52] U.S. Cl. ..... 362/226; 362/252; 362/806

[58] Field of Search ..... 362/123, 226, 362/249, 252, 396, 806; 439/611, 617, 699, 699.1, 699.21

[56] References Cited

U.S. PATENT DOCUMENTS

| | | | |
|---|---|---|---|
| 1,625,248 | 4/1927 | Eckstein | 362/123 |
| 3,522,579 | 8/1970 | Matsuya | 439/699.2 |
| 5,517,394 | 5/1996 | Lin | 362/806 |

*Primary Examiner*—Y. My Quach

[57] ABSTRACT

A lamp holder includes a hollow holder body having a top opening to receive therein a base of a bulb. The holder body has two contact terminals provided therein in a spaced manner to be corresponding to filament extensions of the base of the lamp for establishing electrical connection therewith when the bulb is inserted into the holder body. Electrical wires are inserted into the holder body through a bottom opening of the holder body to physically connect to the contact terminals. A lengthening support is provided to support the holder body, comprising a tubular member made of an insulating material, having a side wall with an open top side and an open lower side. A partition plate is fixed to the open top side to define two openings adjacent thereto. The partition plate is insertable into the holder body through the bottom opening of the holder body to hold the holder body thereon and to at least partially separate the wires from each other with the wires running through the tubular member to respectively extend into the holder body through the openings on the top side of the tubular member. Inverted V-shaped notches are provided on the side wall of the tubular member with a wide opening formed on the lower side of the side wall for fitting onto and mounting to for example a shoot of a tree.

3 Claims, 3 Drawing Sheets

LAMP HOLDER STRUCTURE

FIELD OF THE INVENTION

The present invention relates generally to a light string for decorating Christmas or holiday wreath, garland and tree and in particular to an improved lamp holders comprised of the light string.

BACKGROUND OF THE INVENTION

Light strings have been widely used to decorate trees or garlands in a holiday, such as Christmas. The light string comprises electrical wires to which a plurality of lamp holders are attached. Each of the lamp holders receives and holds a lamp thereon. The lamps may be of different colors and are lighted in a given sequence to provide a romantic atmosphere in the holiday.

Conventionally, the lamp holders comprise a hollow body having a top opening to receive the insertion of the base of a lamp. The holder body also has a bottom opening to allow the insertion of the electrical wire. The holder body has two contact terminals fixed therein to be in electrical connection with the wires so as to contact the two terminals of the lamp when the lamp is inserted therein and thus establish electrical connection between the lamp and the wires. An example of the conventional lamp holder, together with a lamp, is shown in FIG. 3 of the attached drawings in which the holder is designated with reference numeral 10, the lamp 12, the wires 14 and the contacts 16.

A disadvantage associated with the conventional lamp holder is that the two contacts 16 and the associated end portions of the wires 14 that are received within the holder body 10 may get into contact with each other so as to cause electrical short-circuiting.

Further, the conventional lamp holder has a very limited height as measured from the bottom side to the top side. This may cause the lamp to be hidden by for example tree leaves when it is mounted on a tree. Besides, the conventional lamp holder is secured on for example the tree by winding the wires along for example the tree branch. This is not very precise and elegant.

Thus, it is desirable to have an improved lamp holder structure which overcomes the above-discussed problems of the prior art lamp holder structure.

SUMMARY OF THE INVENTION

It is therefore an object of the present invention to provide a lamp holder structure which comprises a lengthening support to attach to the lamp holder so as to support the lamp holder in a higher altitude.

It is another object of the present invention to provide a lamp holder structure which comprises a support member having a partition plate made of an insulating material to be inserted to the holder body to at least partially separate the wires that are connected to the contact terminals from each other so as to reduce the possibility of electrical short-circuiting.

It is a further object of the present invention to provide a lamp holder structure which comprises a support member to which the holder body is attached, the support member having two inverted V-shaped notches formed on the lower side thereof for fitting onto and mounting to for example a shoot of a tree.

To achieve the above objects, there is provided a lamp holder comprising a hollow holder body having a top opening to receive therein a base of a bulb. The holder body has two contact terminals provided therein in a spaced manner to be corresponding to filament extensions of the base of the lamp for establishing electrical connection therewith when the bulb is inserted into the holder body. Electrical wires are inserted into the holder body through a bottom opening of the holder body to physically connect to the contact terminals. A lengthening support is provided to support the holder body, comprising a tubular member made of an insulating material, having a side wall with an open top side and an open lower side. A partition plate is fixed to the open top side to define two openings adjacent thereto. The partition plate is insertable into the holder body through the bottom opening of the holder body to hold the holder body thereon and to at least partially separate the wires from each other with the wires running through the tubular member to respectively extend into the holder body through the openings on the top side of the tubular member. Inverted V-shaped notches are provided on the side wall of the tubular member with a wide opening formed on the lower side of the side wall for fitting onto and mounting to for example a shoot of a tree.

These and other objects and advantages of the present invention will become more apparent from a consideration of the following detailed description of a preferred embodiment thereof, when read in conjunction with the accompanying drawings, wherein:

DETAILED DESCRIPTION OF THE PREFERRED EMBODIMENT

Figure 1:
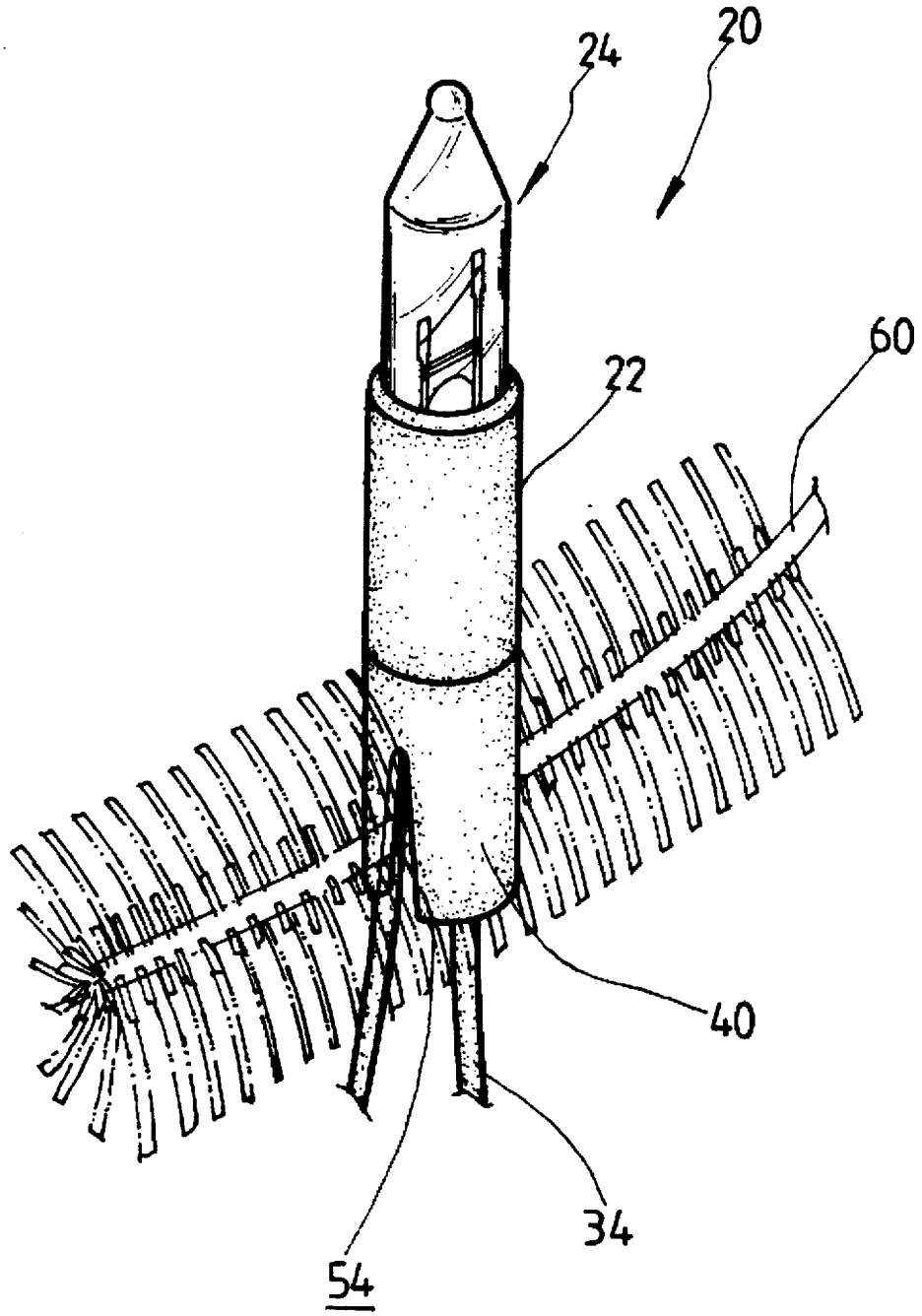
FIG. 1 is a perspective view showing a lamp holder constructed in accordance with the present invention mounted on a shoot of a tree.
Figure 2:
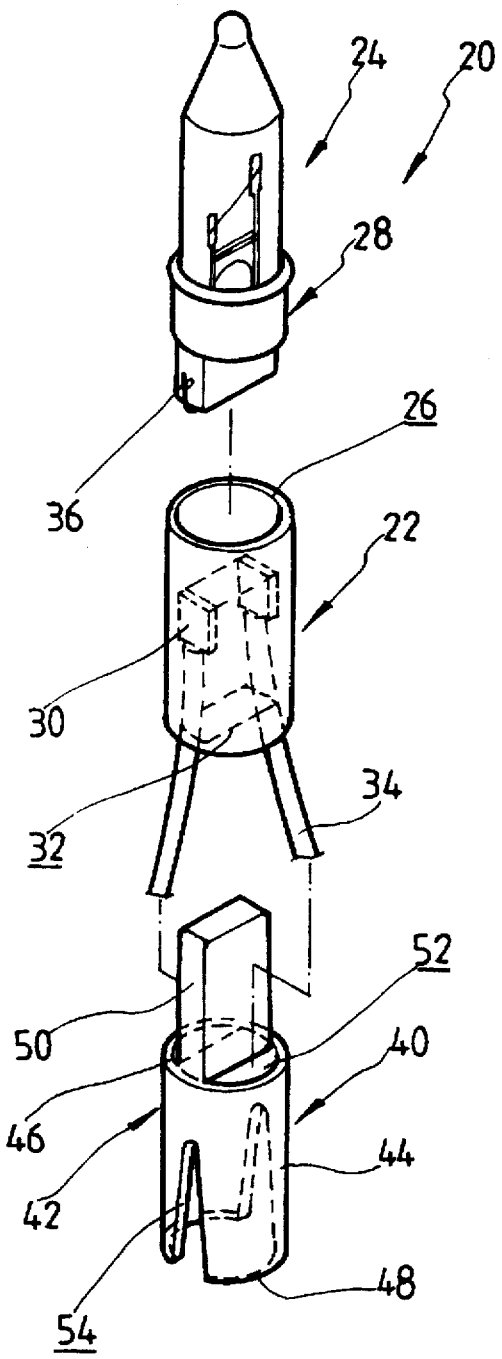
FIG. 2 is an exploded perspective view showing the lamp holder of the present invention.
Figure 3:
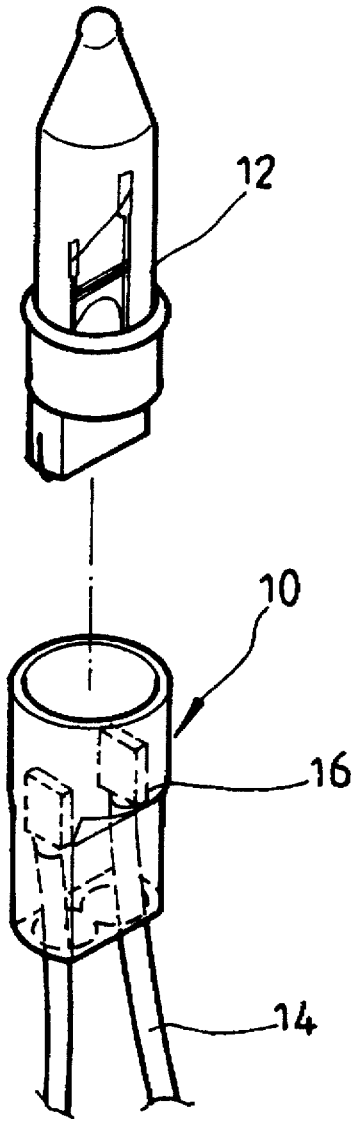
FIG. 3 PRIOR ART
FIG. 3 shows an exploded perspective view of a prior art lamp holder.

Referring to the drawings and in particular to FIGS. 1 and 2, wherein a lamp holder constructed in accordance with the present invention, generally designated with the reference numeral 20, is shown, the lamp holder 20 comprises a holder body 22, preferably a hollow member, for receiving and holding therein a lamp bulb 24. The holder body 22 has a top opening 26 for the entry of the base 28 of the lamp bulb 24. Inside the holder body 22, two spaced terminal contacts 30, respectively representing the cathode and anode of the holder 20, are provided. The holder body 22 also has a bottom opening 32 through which wires 34 are inserted to physically connected to the contact terminals 30. The bulb 24 has conductive filaments 36 extending outside the base 28 and corresponding to the contact terminals 30 of the holder body 22 so that when the bulb 24 is inserted into the holder body 22, the filaments 36 are brought into physical and thus electrical connection with the contact terminals 30 for the supply of electricity to the lamp bulb 24 through the wires 34.

The lamp holder 20 of the present invention further comprises a lengthening support made of an insulating material, generally designated with the reference numeral 40, which comprises a tubular member 42 preferably having a cylindrical side wall 44 with an open top side 46 and an open lower side 48. The open top side 46 of the tubular member 42 has a partition plate 50 fixed thereon. In the embodiment illustrated, the lengthening support 40 comprises a cylindrical tubular member 42 and the partition plate 50 is integrally formed on the top side 46 thereof and substantially corresponding to a diameter of the cylindrical tubular member 42 so as to divide the top side 46 of the cylindrical tubular member 42 into two substantially identical halves, as shown in FIG. 2, each defining a through hole 52 immediately adjacent to the partition plate 50.

The partition plate 50 is dimensioned to fit into the bottom opening 32 of the holder body 22 to such an extent that the partition plate 50 is capable to prevent the contact terminals 30 from contacting each other by at least partially separating the wires 34 connected thereto from each other, but still allows the base 28 of the lamp bulb 24 to get into the holder body 22 to establish electrical connection between the filaments 36 of the bulb 24 and the contact terminals 30 of the holder body 22.

The wires 34 are respectively inserted through the holes 52 to run through the tubular member 42 and extend out of the lower side 48 of the lengthening support 40 so that the partition plate 50 is allowed to closely fit into the bottom opening 32 of the holder body 22.

The lengthening support 40 is also provided with two opposite deep notches 54 on the side wall 44 which extend from the lower side 48 of the lengthening support 40 and preferably each defining an inverted V shape so as to form a wide opening on the lower side 48. The inverted V-shaped notches 54 allows the lengthening support 40 to fix on for example a shoot 60, see FIG. 1, in a very elegant manner by fitting the notches 54 onto the shoot 60.

It is also possible to provide more than two such notches 54 on the side wall 44 of the lengthening support 40.

The lengthening support 40 allows the lamp holder 20 attached thereon to float on the shoot 60 at a higher altitude, as compared with the conventional lamp holder which does not incorporate the lengthening support 40, so that the decoration function of the lamp holder can be improved.

Those skilled in the art will readily recognize that various modifications of the present invention may be made without departing the scope of the present invention defined in the appended claim. Accordingly, the preferred embodiment illustrated and discussed herein should be understood to be exemplary only in nature and the scope of the instant invention should be limited only by that of the following claims.

What is claimed is:

1. A lamp holder structure comprising a hollow holder body having a top opening to receive therein a base of a bulb, two contact terminals being provided inside the holder body in a spaced manner corresponding and connecting and connecting to filament extensions of the base of the bulb for establishing electrical connection therewith, electrical wires being inserted into the holder body through a bottom opening of the holder body and physically connecting, to the contact terminals of the holder body, the improvements comprising an elongated tubular member made of an insulating material, having a side wall with an open top side and an open lower side, a partition plate being fixed to the open top side to define two openings adjacent the partition plate, the partition plate being inserted into the holder body through the bottom opening of the holder body and holding the holder body thereon and at least partially separate the wires from each other with the wires inserted into the bottom opening of the holder body through the open lower side of the tubular member and respectively extending through the openings on the top open side of the tubular member.

2. The lamp holder structure as claimed in claim 1, wherein the side wall of the tubular member comprises at least two opposite deep notches formed thereon and extending from the open lower side of the tubular member toward the open top side.

3. The lamp holder structure as claimed in claim 2, wherein each of the notches having an inverted V shape with a wide opening on the open lower side of the side wall of the tubular member.

* * * * *